US008807363B1

(12) United States Patent
Gilliam

(10) Patent No.: US 8,807,363 B1
(45) Date of Patent: Aug. 19, 2014

(54) WINE CORK HAVING MOLDED ANTI-TAINT BARRIER TIP

(71) Applicant: James R. Gilliam, Clearwater, FL (US)

(72) Inventor: James R. Gilliam, Clearwater, FL (US)

( * ) Notice: Subject to any disclaimer, the term of this patent is extended or adjusted under 35 U.S.C. 154(b) by 0 days.

(21) Appl. No.: 13/897,420

(22) Filed: May 19, 2013

(51) Int. Cl.
*B65D 39/00* (2006.01)

(52) U.S. Cl.
USPC ..... 215/364; 215/355

(58) Field of Classification Search
USPC ..... 215/233, 247–249, 355, 358, 362, 364
See application file for complete search history.

(56) References Cited

U.S. PATENT DOCUMENTS

| | | | | | |
|---|---|---|---|---|---|
| 288,521 | A * | 11/1883 | Walker | 215/364 |
| 368,228 | A * | 8/1887 | Morehouse | 215/364 |
| 443,971 | A * | 12/1890 | McHugh | 215/364 |
| 1,115,597 | A * | 11/1914 | Sherman | 215/247 |
| 1,146,036 | A * | 7/1915 | Spinks | 215/360 |
| 1,375,471 | A * | 4/1921 | Sherman | 215/247 |
| 2,848,130 | A * | 8/1958 | Jesnig | 215/45 |
| 4,111,326 | A * | 9/1978 | Percarpio | 215/247 |
| 4,483,451 | A * | 11/1984 | Gorski | 215/296 |
| 4,521,266 | A * | 6/1985 | Careddu | 156/242 |
| 5,279,606 | A * | 1/1994 | Haber et al. | 604/403 |
| 5,447,246 | A * | 9/1995 | Finke | 215/233 |
| 5,449,080 | A * | 9/1995 | Finke | 215/233 |
| 5,553,728 | A * | 9/1996 | Finke | 215/233 |
| 5,662,233 | A * | 9/1997 | Reid | 215/273 |
| 5,975,322 | A * | 11/1999 | Reid | 215/273 |
| 6,152,966 | A * | 11/2000 | Conrad et al. | 8/111 |
| 6,205,744 | B1 * | 3/2001 | Zurlinden et al. | 53/341 |
| 6,349,524 | B1 * | 2/2002 | Zurlinden et al. | 53/423 |
| 6,355,320 | B1 * | 3/2002 | Allman et al. | 428/36.5 |
| 6,601,722 | B1 * | 8/2003 | Litoux-Desrue et al. | 215/364 |
| 6,607,087 | B2 * | 8/2003 | Turnwald | 215/360 |
| 6,613,406 | B1 * | 9/2003 | Yaniger | 428/34.4 |
| 6,796,449 | B2 * | 9/2004 | Fragola | 215/364 |
| 7,063,221 | B2 * | 6/2006 | Garcia-Cuenca et al. | 215/355 |
| 7,426,999 | B2 * | 9/2008 | Leendersten et al. | 215/355 |
| 7,533,781 | B1 * | 5/2009 | Spooner | 215/297 |
| 7,595,014 | B2 * | 9/2009 | Pinto Coelho et al. | 264/109 |
| 7,993,743 | B2 * | 8/2011 | Taylor | 428/334 |
| 8,011,522 | B2 * | 9/2011 | Romao de Sousa | 215/364 |
| 8,414,809 | B2 * | 4/2013 | Moura Bordado et al. | 264/113 |
| 2002/0153342 | A1 * | 10/2002 | Fragola | 215/364 |
| 2003/0019830 | A1 * | 1/2003 | Garcia-Cuenca et al. | 215/355 |
| 2004/0031770 | A1 * | 2/2004 | Gardner et al. | 215/297 |
| 2004/0178168 | A1 * | 9/2004 | Matheson | 215/364 |
| 2004/0232101 | A1 * | 11/2004 | Gardner et al. | 215/277 |
| 2004/0232102 | A1 * | 11/2004 | Gardner et al. | 215/299 |

(Continued)

FOREIGN PATENT DOCUMENTS

| | | | | |
|---|---|---|---|---|
| EP | 1166982 | A2 * | 1/2002 | B27J 5/00 |

*Primary Examiner* — J. Gregory Pickett
*Assistant Examiner* — Ned A Walker

(57) ABSTRACT

An anti-taint molded barrier tip system has a primary component and a tip component. The primary component is formed of an upper section, a lower section, and an intermediate section. The upper and lower sections are cylindrical. The diameter of the lower section is less than the diameter of the upper section. The intermediate section is formed as a cylindrical notch with a diameter less than the diameter of the lower section. The tip component has an exterior surface and a lower surface and an annular upper surface. The tip component has a recess extending downwardly from the annular upper surface. The recess has an enlarged cylindrical lower region receiving the lower section of the primary component. The recess has a cylindrical upper region receiving the intermediate section of the primary component.

1 Claim, 3 Drawing Sheets

(56) References Cited

U.S. PATENT DOCUMENTS

| | | | | |
|---|---|---|---|---|
| 2004/0238479 | A1* | 12/2004 | Caswell et al. | 215/364 |
| 2006/0151422 | A1* | 7/2006 | Manley | 215/341 |
| 2006/0261029 | A1* | 11/2006 | Casini et al. | 215/355 |
| 2008/0078737 | A1* | 4/2008 | Brennan et al. | 215/364 |
| 2009/0039052 | A1* | 2/2009 | Galvez-Ramos | 215/356 |
| 2009/0236306 | A1* | 9/2009 | Moura Bordado et al. | 215/362 |
| 2011/0226722 | A1* | 9/2011 | Romao de Sousa | 215/362 |

* cited by examiner

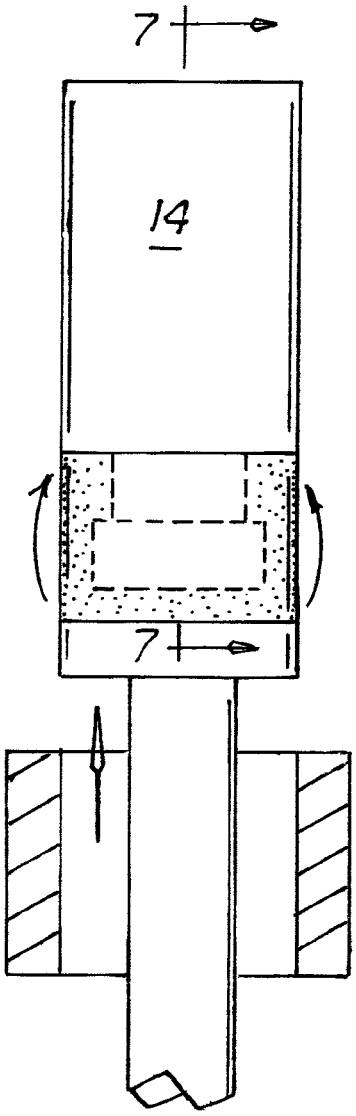
FIG. 6
FIG. 7
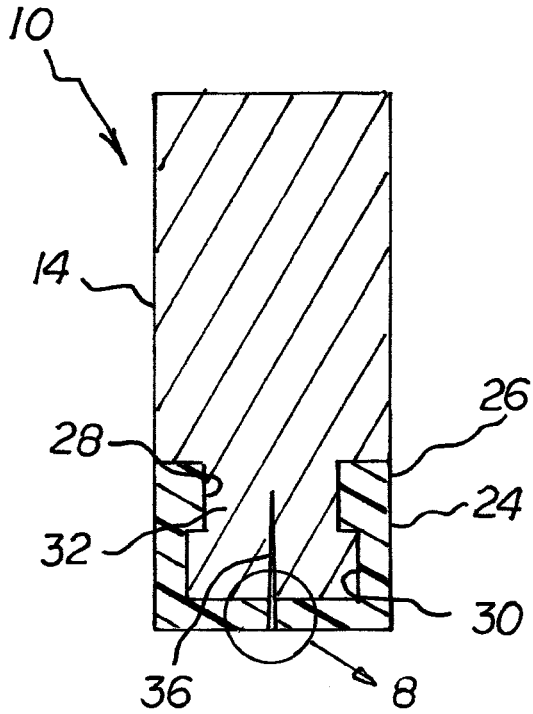
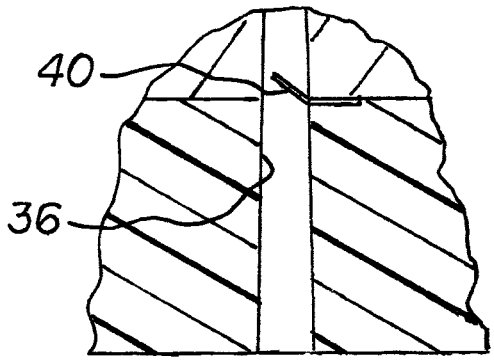
FIG. 8

WINE CORK HAVING MOLDED ANTI-TAINT BARRIER TIP

BACKGROUND OF THE INVENTION

1. Field of the Invention

The present invention relates to an anti-taint molded barrier tip system and method for wine corks and more particularly pertains to protecting wine and prevent wine spoilage due to cork taint, the protecting and the preventing being done in a sanitary, safe, convenient and economical manner.

2. Description of the Prior Art

The use of wine cork systems of known designs and configurations are known in the prior art. More specifically, wine cork systems of known designs and configurations previously devised and utilized for the purpose of preventing wine spoilage are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe an anti-taint molded barrier tip system and method for wine corks that allows for protecting wine and preventing wine spoilage due to cork taint, the protecting and the preventing being done in a sanitary, safe, convenient and economical manner.

In this respect, the anti-taint molded barrier tip system and method for wine corks according to the present invention substantially departs from the conventional concepts and designs of the prior art, and in doing so provides an apparatus primarily developed for the purpose of protecting wine and preventing wine spoilage due to cork taint, the protecting and the preventing being done in a sanitary, safe, convenient and economical manner.

Therefore, it can be appreciated that there exists a continuing need for a new and improved anti-taint molded barrier tip system and method for wine corks which can be used to protect wine and prevent wine spoilage due to cork taint, the protecting and the preventing being done in a sanitary, safe, convenient and economical manner. In this regard, the present invention substantially fulfills this need.

SUMMARY OF THE INVENTION

In view of the foregoing disadvantages inherent in the known types of wine cork systems of known designs and configurations now present in the prior art, the present invention provides an improved anti-taint molded barrier tip system and method for wine corks. As such, the general purpose of the present invention, which will be described subsequently in greater detail, is to provide a new and improved anti-taint molded barrier tip system and method for wine corks which has all the advantages of the prior art and none of the disadvantages.

To attain this, the present invention essentially comprises an anti-taint molded barrier tip system and method. The system has a primary component and a tip component. The primary component is formed of an upper section, a lower section, and an intermediate section. The upper and lower sections are cylindrical. The diameter of the lower section is less than the diameter of the upper section. The intermediate section is formed as a cylindrical notch with a diameter less than the diameter of the lower section. The tip component has an exterior surface and a lower surface and an annular upper surface. The tip component has a recess extending downwardly from the annular upper surface. The recess has an enlarged cylindrical lower region receiving the lower section of the primary component. The recess has a cylindrical upper region receiving the intermediate section of the primary component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anti-taint molded barrier tip system and method for wine corks which has all of the advantages of the prior art wine cork systems of known designs and configurations and none of the disadvantages.

It is another object of the present invention to provide a new and improved anti-taint molded barrier tip system and method for wine corks which may be easily and efficiently manufactured and marketed.

It is further object of the present invention to provide a new and improved anti-taint molded barrier tip system and method for wine corks which is of durable and reliable constructions.

An even further object of the present invention is to provide a new and improved anti-taint molded barrier tip system and method for wine corks which is susceptible of a low cost of manufacture with regard to both materials and labor, and which accordingly is then susceptible of low prices of sale to the consuming public, thereby making such anti-taint molded barrier tip system and method for wine corks economically available to the buying public.

Lastly, it is an object of the present invention to provide an anti-taint molded barrier tip system and method for wine corks for protecting wine and preventing wine spoilage due to cork taint, the protecting and the preventing being done in a sanitary, safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 4, 5 and 6 are cross sectional views of the stopper illustrating various stages in the fabrication of the system of the present invention.

FIG. 7 is a cross sectional view of the stopper taken along line 7-7 of FIG. 6.

FIG. 8 is an enlarged cross sectional view of the stopper taken at circle 8 of FIG. 7.

The same reference numerals refer to the same parts throughout the various Figures.

DESCRIPTION OF THE PREFERRED EMBODIMENT

Figure 1:
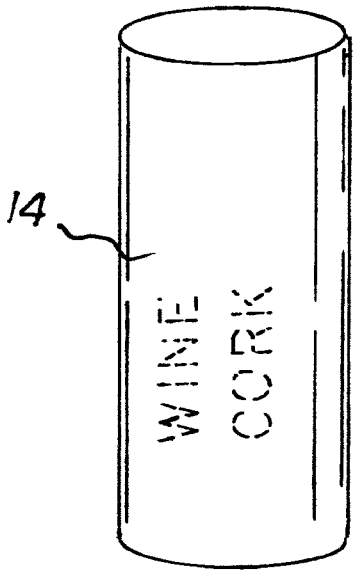
FIG. 1 is a perspective illustration of a stopper adapted to be constructed in accordance with the principles of the present invention.
Figure 2:
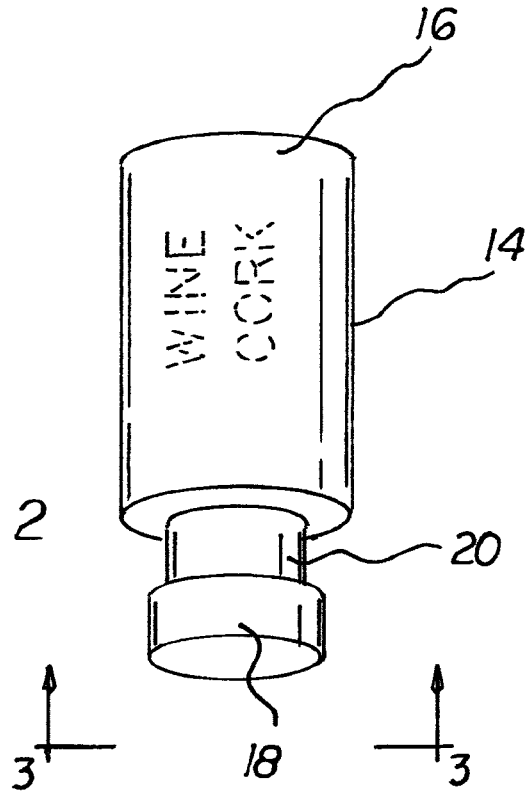
FIG. 2 is a perspective illustration of the stopper of FIG. 1 cut during the fabrication of the system of the present invention.
Figure 3:
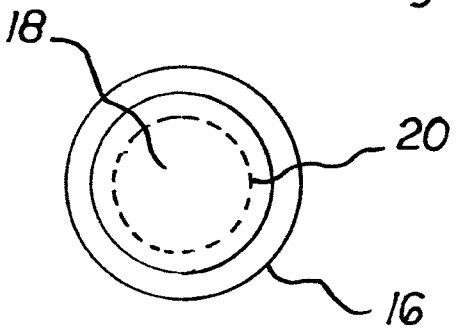
FIG. 3 is a bottom view of the system taken along line 3-3 of FIG. 2.
Figure 4:
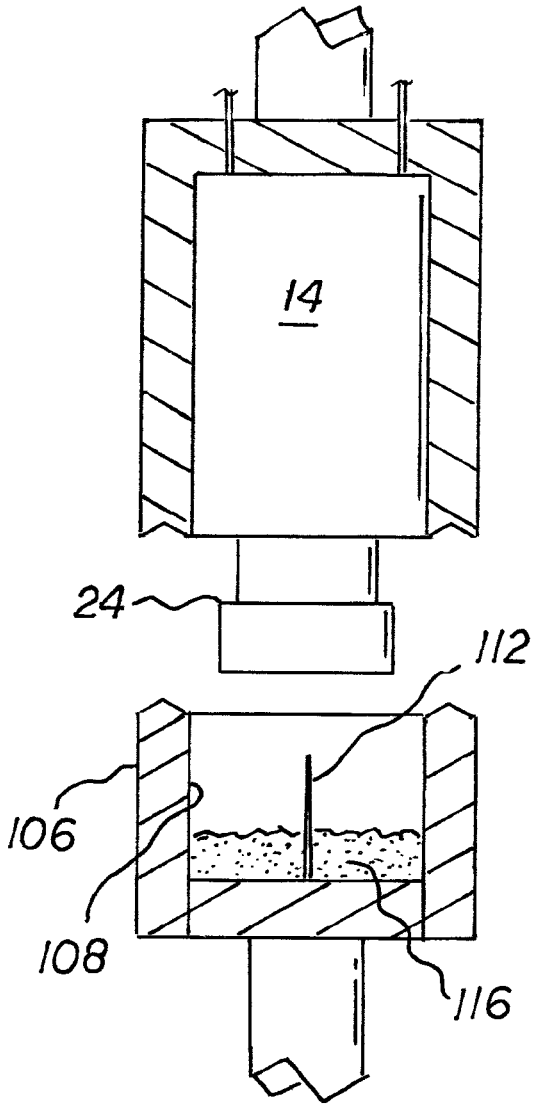
Figure 5:
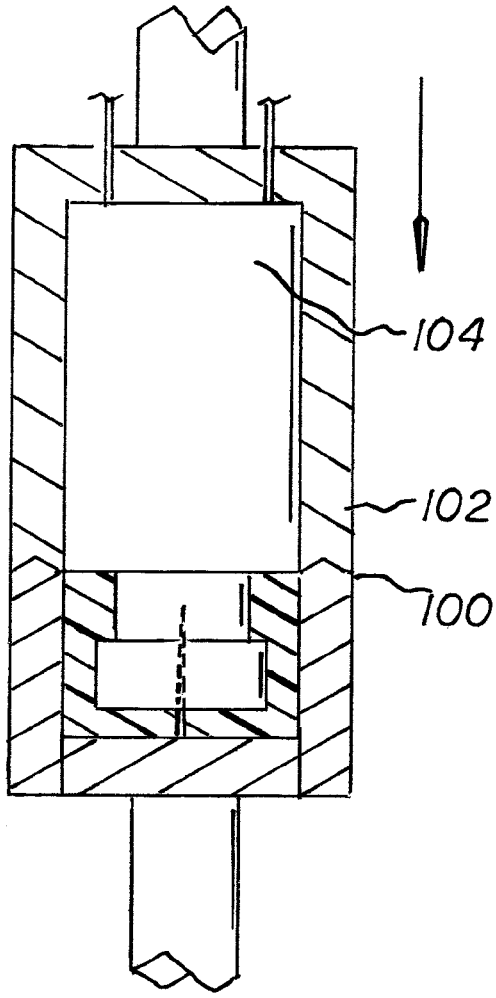

With reference now to the drawings, and in particular to FIG. 1 thereof, the preferred embodiment of the new and improved anti-taint molded barrier tip system and method for wine corks embodying the principles and concepts of the present invention and generally designated by the reference numeral 10 will be described.

The present invention, the anti-taint molded barrier tip system and method for wine corks 10 is comprised of a plurality of components. Such components in their broadest context include a primary component and a tip. Such components are individually configured and correlated with respect to each other so as to attain the desired objective.

The anti-taint molded barrier tip system 10 for wine corks is to protect wine and prevent wine spoilage due to cork taint. The protecting and the preventing are done in a sanitary, safe, convenient and economical manner. First provided is a primary component 14. The primary component is formed of an upper section 16, a lower section 18, and an intermediate section 20. The primary component is formed integrally of a cork material.

The upper section 16 is formed in a cylindrical configuration with an upper length and an upper diameter. The upper section has a cylindrical upper surface peripherally and a circular top surface.

The lower section 18 is formed in a cylindrical configuration with a lower length less than the upper length and a lower diameter less than the upper diameter. The lower section has a cylindrical lower surface peripherally and a circular bottom surface.

The intermediate section 20 is between the upper and lower sections. The intermediate section is formed as a notch in a cylindrical configuration with an intermediate length essentially equal to the lower length and an intermediate diameter less than the lower diameter. The intermediate section has a cylindrical intermediate surface peripherally. The upper and lower and intermediate sections are integrally formed with a common central axis.

Next provided is a tip component 24. The tip component has a cylindrical exterior face 26 peripherally, a circular lower face, and an annular upper face. The tip component has a recess 28 extending downwardly from the annular upper face. The recess includes an enlarged lower region 30 in a cylindrical configuration receiving the lower section of the primary component. The recess includes an upper region 32 in a cylindrical configuration receiving the intermediate section of the primary component. The tip component is fabricated of a poly resin material.

A conical pinhole 36 is provided extending upwardly through the circular lower face of the tip component and through the lower section of the primary component into and terminating within the intermediate section of the primary component. The pinhole is adapted to constitute a check valve for the flow of air between wine in a bottle receiving the system and the atmosphere.

Lastly, a one way flapper valve 40 is provided. The one way flapper valve is fabricated of an elastomeric material and is adapted to overlie the pinhole between the primary component and the tip component. The one way flapper valve is adapted to allow the flow of wine to enter the primary component while at the same time preventing contaminants including "cork taint" from entering the wine.

The present invention includes an anti-taint molded barrier tip fabrication method for wine stoppers comprised of method steps.

The first step is providing a primary component formed of upper, lower and intermediate sections. The upper section is formed in a cylindrical configuration with an upper length and an upper diameter. The lower section is formed in a cylindrical configuration with a lower length less than the upper length and a lower diameter less than the upper diameter. The intermediate section is formed as a notch in a cylindrical configuration with an intermediate length essentially equal to the lower length and an intermediate diameter less than the lower diameter.

The next step is providing a mold 100 with an upper half 102 in a cylindrical configuration with a closed top and an open bottom with an upper cavity 104 in a cylindrical configuration extending upwardly from the open bottom. The mold has a lower half 106 in a cylindrical configuration with a closed bottom and an open top with a lower cavity 108 in a cylindrical configuration extending downwardly from the open top. The upper and lower cavities have a common diameter and a common axis.

The next step is providing an upwardly extending needle 112 in the lower cavity extending upwardly from the closed bottom of the lower half. The needle is conical with an upper end terminating at an intermediate elevation of the lower cavity.

The next step is supporting the upper section of the primary component in the upper cavity of the mold with the intermediate and lower sections of the primary component depending downwardly therefrom.

The next step is pouring a quantity of poly resin 116 into the lower cavity to fill from 25 percent to 75 percent of the lower cavity.

The next step is axially moving together the upper half and the lower half of the mold whereby the lower section and intermediate section of the primary component enter the lower cavity with the primary component spaced from the closed bottom of the lower half of the mold and with the upper end of the needle piercing the lower section of the primary component and a portion of the intermediate section of the primary component.

The final step is heating the mold to expand the poly resin and form a tip component of the system. The tip component has a cylindrical exterior face peripherally, a circular lower face, and an annular upper face. The tip section has a recess extending downwardly from the annular upper face. The recess includes an enlarged lower region in a cylindrical configuration peripherally receiving the lower section of the primary component. The recess also includes an upper region in a cylindrical configuration peripherally receiving the intermediate section of the primary component.

The present invention allows the use of varied quality and unknown origin of cork materials by protecting to wine and prevention of spoilage due to "cork taint". The invention also allows wine makers to use cork materials that may, without the use of this barriers cork tip, otherwise cause off color, strange aroma and bad flavor of wine.

The present invention uses proven wine industry approved poly resins to mold an anti-taint tip on natural corks forming a barrier between the cork and the wine yet allowing enough wine to penetrate the cork to expand the cork in the interior neck of the bottle and maintain a level of moisture to develop a proper seal.

The barrier tip has, as an option, a built-in poly check valve. Such check valve is designed to allow the wine to enter the cork. Such check valve also prevents contaminants including "cork taint" from entering the wine.

The barrier tip is designed for use of standard wine cork removal systems with little additional resistance from the poly tip.

The poly molding material can be made of a natural cork color making it visually non-detectable or it may be made of a dramatically different color to function as an indicia of the wine or to simply demonstrate the presence of the anti-taint barrier system.

During fabrication, the barrier poly resin tip component is molded to the precise exterior peripheral diameter of the cork primary component and molded around the annular inverted notch and the reduced diameter tip component of the cork. This is to secure the tip component and make it permanently attached to the primary component.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anti-taint molded barrier tip system (10) for wine corks adapted to protect wine and prevent wine spoilage due to cork taint, the protecting and the preventing being done in a sanitary, safe, convenient and economical manner, the system comprising, in combination:

a primary component (14) formed of an upper section (16), a lower section (18), and an intermediate section (20) between the upper and lower sections;

the upper section (16) being formed in a cylindrical configuration with an upper length and an upper diameter, the upper section having a cylindrical upper surface peripherally and a circular top surface;

the lower section (18) being formed in a cylindrical configuration with a lower length less than the upper length and a lower diameter less than the upper diameter, the lower section having a cylindrical lower surface peripherally and a circular bottom surface;

the intermediate section (20) formed as a notch in a cylindrical configuration with an intermediate length essentially equal to the lower length and an intermediate diameter less than the lower diameter, the intermediate section having a cylindrical intermediate surface peripherally, the upper and lower and intermediate sections being integrally formed of a cork material with a common central axis;

a tip component (24) having a cylindrical exterior face (26) peripherally and a circular lower face and an annular upper face, the tip component having a recess (28) extending downwardly from the annular upper face, the recess including an enlarged lower region (30) in a cylindrical configuration receiving the lower section of the primary component, the recess including an upper region (32) in a cylindrical configuration receiving the intermediate section of the primary component, the tip component being fabricated of a poly resin material;

a conical pinhole (36) extending upwardly through the circular lower face of the tip component and through the lower section of the primary component into and terminating within the intermediate section of the primary component, the pinhole adapted to constitute a check valve for the flow of air between wine in a bottle receiving the system and atmosphere; and a one way flapper valve (40) fabricated of an elastomeric material and adapted to overlie the pinhole between the primary component and the tip component, the flapper valve adapted to allow the flow of wine to enter the primary component while at the same time preventing contaminants including "cork taint" from entering the wine.

* * * * *